United States Patent [19]

Suzuki

[11] Patent Number: 5,045,650

[45] Date of Patent: Sep. 3, 1991

[54] FINGER SWITCH

[75] Inventor: Hideo Suzuki, Hamamatsu, Japan

[73] Assignee: Yamaha Corporation, Hamamatsu, Japan

[21] Appl. No.: 466,203

[22] Filed: Jan. 17, 1990

Related U.S. Application Data

[62] Division of Ser. No. 161,176, Feb. 26, 1988, Pat. No. 4,920,848.

[30] Foreign Application Priority Data

Feb. 27, 1987 [JP] Japan ..... 62-44233
Feb. 27, 1987 [JP] Japan ..... 62-44234

[51] Int. Cl.[5] ..... H01H 35/00
[52] U.S. Cl. ..... 200/52 R; 200/DIG. 2
[58] Field of Search ..... 200/DIG. 2, 52 R, 520, 200/537, 329, 335, 341-345; 235/145 R; 341/27

[56] References Cited

U.S. PATENT DOCUMENTS 1,197,652 9/1916 Newton ..... 200/DIG. 2 X
1,199,710 9/1916 Newton ..... 200/DIG. 2 X
1,335,272 3/1920 Broughton ..... 200/DIG. 2 X
1,527,792 2/1925 French ..... 200/DIG. 2 X
1,906,193 4/1933 Vitale ..... 200/DIG. 2 X
3,383,487 5/1968 Wiener ..... 200/DIG. 2 X
4,517,424 5/1985 Kroczynski ..... 200/DIG. 2 X
4,722,625 2/1988 O'Brien ..... 200/DIG. 2 X

FOREIGN PATENT DOCUMENTS 1174044 9/1984 Canada ..... 341/27

*Primary Examiner*—J. R. Scott
*Attorney, Agent, or Firm*—Spensley Horn Jubas & Lubitz

[57] ABSTRACT

A finger switch is mounted at a player's finger so as to detect bedding and stretching actions of a player's finger. Such finger switch includes a thin plate made of a plastic material which is mounted on the back of the player's finger, a push button switch mounted adjacent the thin plate near a center portion of the player's finger, and a movable member which is moved in response to the bending and stretching actions of the player's finger. When the player bends his finger, the movable member is moved toward the push button switch so that the push button switch will be pushed and activated by the movable member. By mounting a plurality of such finger switches on the fingers of the player, a musical scale or a tone pitch of a musical tone to be generated can be controlled based on a combination of on/off states of the push buttons.

3 Claims, 3 Drawing Sheets

| | RIGHT HAND | | | LEFT HAND | |
|---|---|---|---|---|---|
| | INDEX FINGER | MIDDLE FINGER | THIRD FINGER | INDEX FINGER | MIDDLE FINGER |
| DO | × | × | × | × | × |
| RE | ○ | × | ○ | | |
| MI | ○ | ○ | × | | |
| FA | ○ | × | × | | |
| SO | × | × | × | × | ○ |
| LA | ○ | ○ | × | | |
| SI | × | ○ | × | | |
| DO | × | × | × | ○ | × |
| RE | ○ | × | × | | |
| MI | × | × | × | ○ | ○ |
| FA | ○ | × | × | | |

○ : ON
× : OFF

FINGER SWITCH

This is a division of application Ser. No. 07/161,176, filed on Feb. 26, 1988, now U.S. Pat. No. 4,920,848.

BACKGROUND OF THE INVENTION

The present invention generally relates to a finger switch, and more particularly to a finger switch which is turned on and off in response to bending and stretching actions of a player's finger so that a musical tone will be generated.

Conventionally, the player inputs performance information to a musical instrument by use of an input apparatus such as a keyboard, so that the musical instrument generates a musical tone having a desirable tone pitch, a desirable tone color and the like.

SUMMARY OF THE INVENTION

It is accordingly a primary object of the present invention to provide a finger switch which is driven on and off in response to the bending and stretching actions of the player's finger so that a melody tone having a desirable musical scale can be generated without using the input apparatus such as the keyboard, for example.

In a first aspect of the invention, there is provided a finger switch comprising: (a) a thin plate made of bendable materials, one edge of the thin plate being mounted near a finger base portion of a player's finger, while another edge of the thin plate is stretched toward a finger tip edge portion of the player's finger, whereby the thin plate can be bent and stretched in response to bending and stretching actions of the player's finger; (b) a gate member having a gate shape, the gate member being mounted between said finger base and said finger tip edge of the player's finger, whereby the thin plate is inserted through inside of the gate member; (c) a contact mounted at the gate member in a direction of the finger tip edge portion; and (d) a contact driving member mounted at another edge of the thin plate, the contact driving member driving the contact to turn on and off in response to the bending and stretching movement of the thin plate.

In a second aspect of the invention, there is provided a musical tone generating apparatus comprising: (a) a plurality detectors each mounted at a player's finger for detecting bending and stretching actions of the player's finger; (b) musical tone data generating means for converting detecting results of the contacts into musical tone data representative of a specific musical tone; and (c) musical tone signal generating means for converting the musical tone data into a musical tone signal, whereby a musical tone corresponding to the musical tone signal is to be generated.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings.

DESCRIPTION OF THE PREFERRED EMBODIMENT

Figure 1:
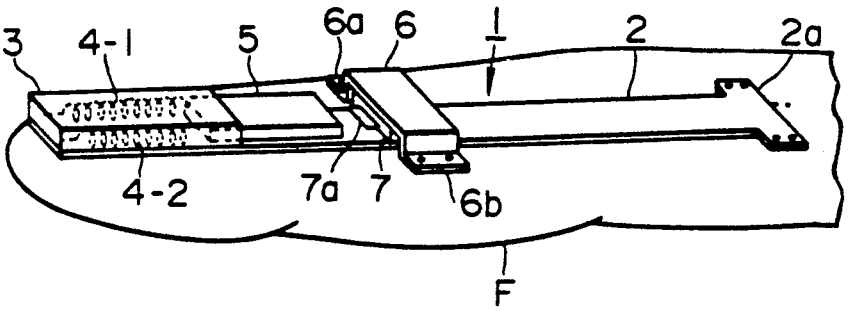
FIG. 1 is a perspective side view showing an embodiment of the finger switch mounted on the player's finger.

Referring now to the drawings, wherein like reference characters designate like or corresponding parts throughout the several views, FIG. 1 is a perspective side view showing an embodiment of the finger switch 1. As shown in FIG. 1, the finger switch 1 is mounted at a certain portion of a mounting member F such as a glove, and such certain portion corresponds to the back of the player's finger. First, a rectangular thin plate 2 is made of plastic (or bendable) material, and a fixing portion 2*a* is mounted to a base of a finger portion of the glove F. In addition, an enclosure 3, which may, for example, have a cylindrical shape or rectangular shape as illustrated and having an opening in a direction of the fixing portion 2*a*, is mounted at an edge portion of the thin plate 2 which is turned in a finger tip direction. Further, springs 4-1 and 4-2 are provided within the enclosure 3. First edges of the springs 4-1 and 4-2 are fixed at a bottom portion of the enclosure 3, and second edges of such springs are fixed at an edge of a movable element 5. These springs 4-1 and 4-2 push the movable element 5 so that the movable element 5 can be freely slid into and out of the enclosure 3. When the glove F is mounted by the player's hand, fixing portions 6*a* and 6*b* mount a gate member 6 to the glove F, independently of the thin plate 2, at a position between a first joint and a second joint of the player's finger. In case of a player's thumb, the fixing portions 6*a* and 6*b* mount the gate member 6 to the glove F at a position between a tip edge and a joint of the player's thumb. This gate member 6 has a gate shape so that a center portion of the thin plate 2 can be inserted through the gate member 6 and freely move through the gate member. A push switch 7 having a push button 7*a* is mounted at an inside plane of the gate member 6 so that the push button 7*a* is turned in the finger tip direction.

Figure 2:
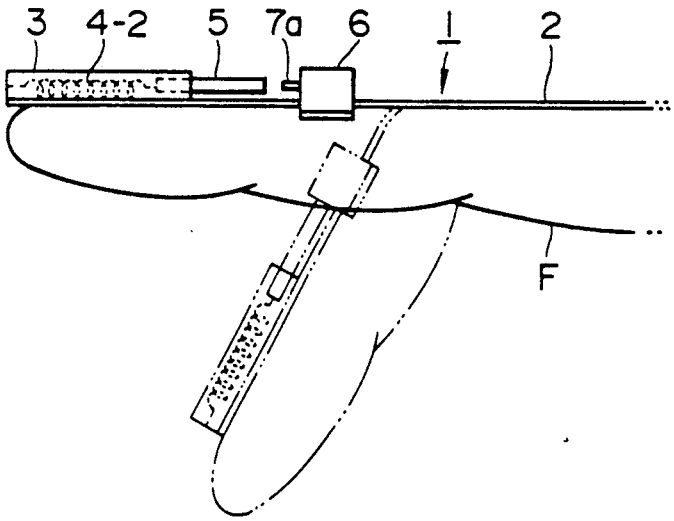
FIG. 2 is a side view showing the finger switch which is operated in response to the bending and stretching actions of the player's finger.

The finger switch 1 is constructed as described heretofore. When the player bends his finger at the first joint as shown in FIG. 2, the thin plate 2 and movable element 5 connected thereto move relative to gate member 6 so that the edge of the movable, element 5 will push the push button 7*a* and the push switch 7 will be turned on. Thereafter, when the player stretches his finger, the movable element 5 moves back to an original position so that the push switch 7 will be turned off. In this case, at a time when the player bends his finger by a predetermined angle and more, the movable element 5 pushes against elastic restoring force of the springs 4-1 and 4-2 so that the movable element 5 can be slid into the bottom portion of the enclosure 3. For this reason, there is no unnatural movement so that the bending action of the player's finger is not stopped at a predetermined angle.

Figure 3:
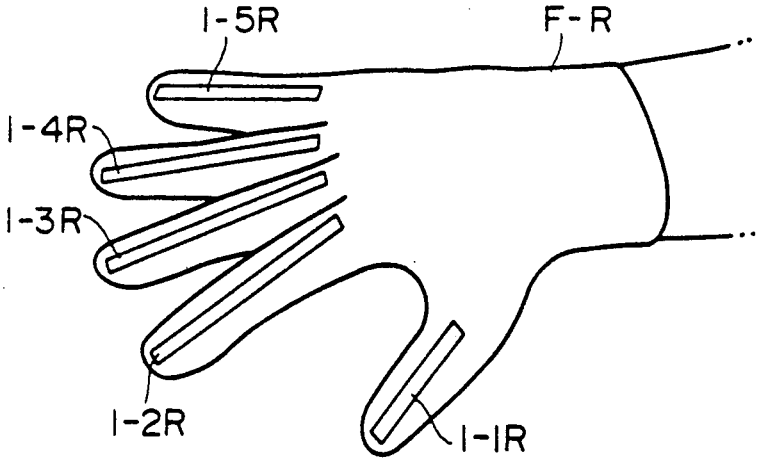
FIG. 3 is a perspective side view showing a glove for a player's right hand mounted with finger switches.
Figure 4:
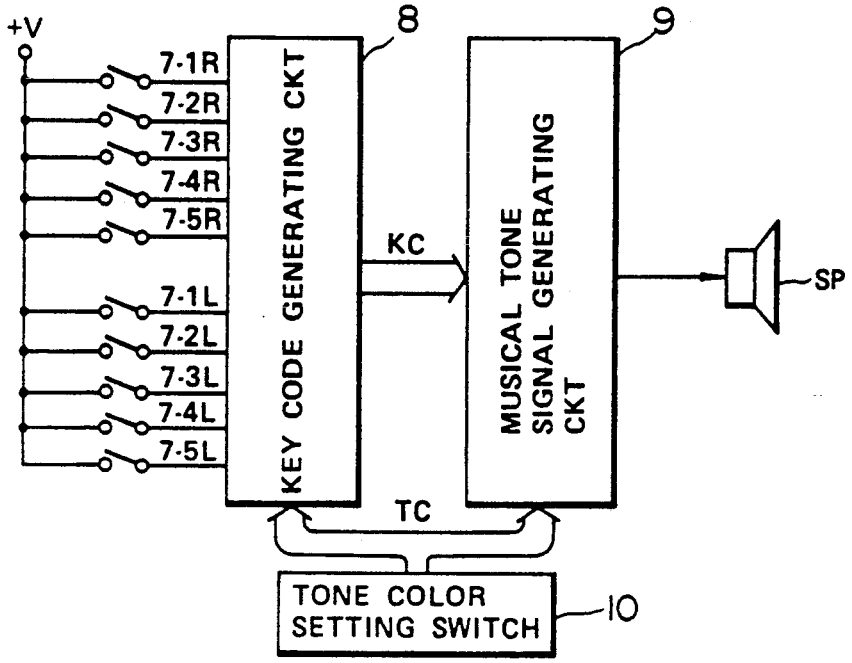
FIG. 4 is a block diagram showing a musical tone generating apparatus using finger switches.

Next, description will be given with respect to an example of the musical tone generating apparatus which employs the finger switch 1 in conjunction with FIGS. 3 and 4. FIG. 3 shows the glove F-R mounted on the player's right hand, and FIG. 4 shows an electric schematic of the musical tone generating apparatus. In addition, another glove for a player's left hand is constructed as similar to the glove F-R shown in FIG. 3, hence, description and drawing thereof will be omitted.

As shown in FIG. 3, five finger switches 1-1R to 1-5R each having the similar construction of the finger switch 1 are respectively mounted at five finger portions of the right glove F-R. These finger switches 1-1R to 1-5R respectively provide push switches 7-1R to 7-5R each having the similar construction of the push switch 7. Similarly, five push switches 7-1L to 7-5L are respectively provided at five finger switches mounted at five finger portions of the left glove (not shown). First terminals of the ten push switches 7-1R to 7-5R and 7-1L to 7-5L are respectively connected to a key code generating circuit 8, and constant voltage +V is supplied to second terminals of these ten push switches. This key code generating circuit 8 inputs on/off states of these ten push switches 7-1R to 7-5R and 7-1L to 7-5L and also tone color code TC which is set by a tone color setting switch 10 arranged on a panel face (not shown). Based on the inputted on/off states and the tone color code TC, the key code generating circuit 8 generates a key code KC.

Figure 5:
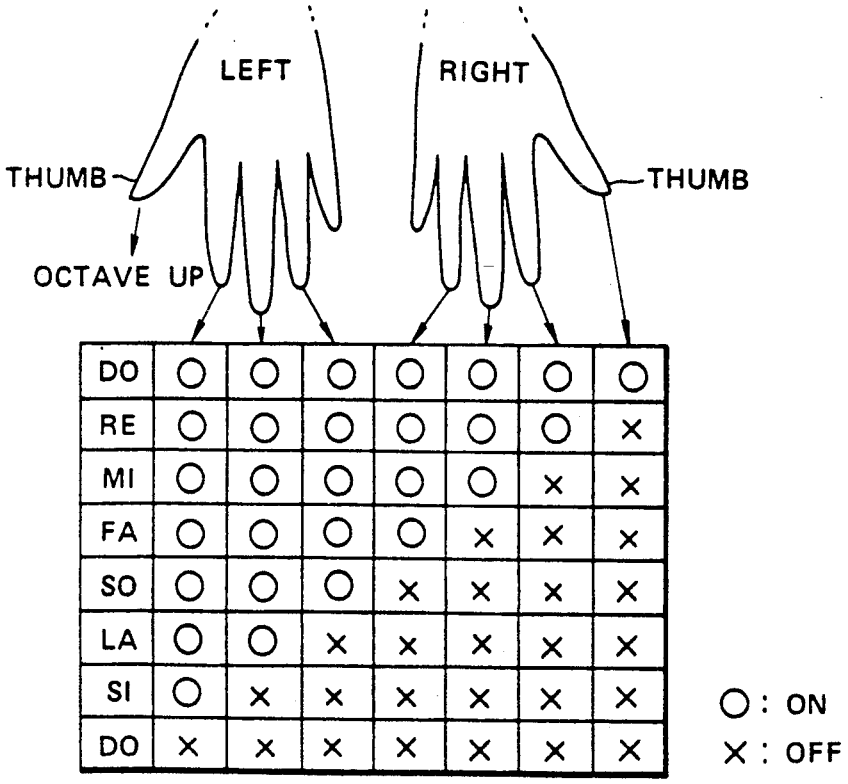
FIG. 5 shows relations between operations of player's fingers and musical scales in case of a saxophone.
Figures 6, 7:
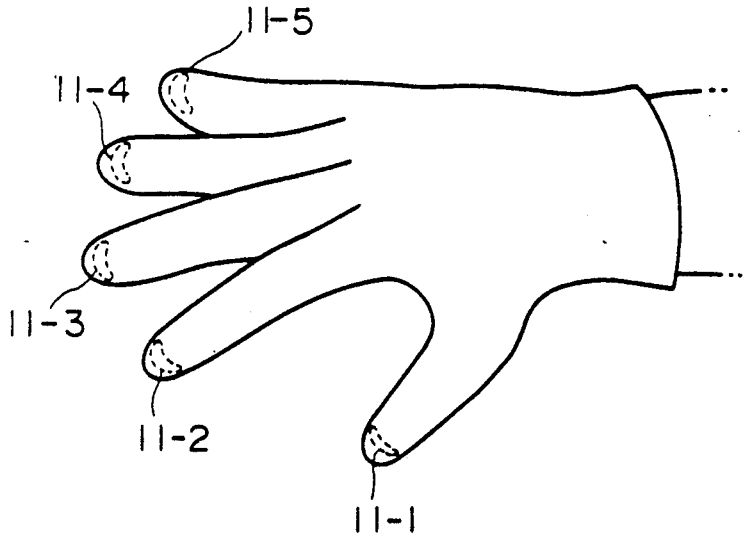
FIG. 6 shows relations between operations of player's fingers and musical scales in case of a trumpet.
FIG. 7 is a perspective side view showing another glove for the player's right hand mounted with finger switches.

More specifically, FIG. 5 shows relations between the on/off states of the push buttons and the musical scales of the saxophone. In FIG. 5, a circle-mark represents that each push button is turned on, while a X-mark represents that each push button is turned off. In response to the operations of the finger switches, the key code generating circuit 8 generates the key code KC corresponding to one of the musical scales do, re, mi, fa, so, la, si and do. In this case, an octave number is changed in response to the on/off state of the push switch 7-1L for the player's left thumb, so that the value of the key code KC is changed. On the other hand, FIG. 6 shows relations between the operations of the player's fingers and musical scales of the trumpet, and such relations for the trumpet are different from those of the saxophone. Next, the key code KC generated in the key code generating circuit 8 is sequentially outputted to a musical tone signal generating circuit 9. This musical tone signal generating circuit 9 inputs the key code KC and the tone color code TC, whereby the musical tone signal generating circuit 9 generates a musical tone signal having a musical size corresponding to the key code KC and a tone color corresponding to the tone color code TC. Such musical tone signal drives a speaker SP.

When the player selects one of the tone colors of the saxophone and the trumpet by using the tone color setting switch 10, the musical tone signal generating circuit 9 inputs the tone color code TC as the set tone color so as to selectively change the tone color of the musical tone to be generated. In addition, the speaker SP generates a melody tone having the tone color of the saxophone or the trumpet by operating the player's fingers in accordance with finger operations shown in FIG. 5 or 6.

In the present embodiment, the tone pitch of the musical tone is controlled in response to the movement of the player's finger. However, the present invention is not limited to that. Hence, it is possible to control a generation of a rhythm tone such as a tone of a percussion musical instrument. In addition, instead of using the finger switch 1, it is possible to employ pressure sensitive elements 11-1 to 11-5 at the finger portions of the glove as shown in FIG. 7. In response to depressing pressure applied to each pressure sensitive element, intrinsic resistance of each pressure sensitive element varies. Therefore, an output level of each pressure sensitive element varies in accordance with the bending and stretching actions of the player's fingers. In this case, it is possible to generate on/off signals based on the output levels of the pressure sensitive elements 11-1 to 11-5 and then supply such on/off signals to the key code generating circuit 8.

In addition, the contact of the finger switch 1 are turned on and off by bending and stretching the player's finger at the first finger joint. However, the present invention is not limited to that. Hence, it is possible to mount the finger switch 1 to the glove so that the contact of the finger switch 1 can be turned on and off by bending and stretching the player's finger at the base finger portion. In addition, the exposed finger switch 1 is mounted at the back of the finger portion of the glove F in the present embodiment. Instead, it is possible to cover the finger switch 1 by a cloth in order that the finger switch 1 is not exposed to the air. Further, instead of mounting the finger switch 1 to the glove F, it is possible to mount the finger switch directly on the player's finger by use of a band.

As described heretofore, it is possible to freely generate the melody tone having the desirable musical scale by using the finger switch and moving the player's finger, for example. In this case, it is not necessary to use the input apparatus such as the keyboard. In addition, it is possible to input movements of the player's fingers in a performance of a clarinet as performance information of an electronic musical instrument other than the clarinet, for example.

This invention may be practiced or embodied in still other ways without departing from the spirit or essential character thereof. Therefore, the preferred embodiment described herein is illustrative and not restrictive, the scope of the invention being indicated by the appended claims and all variations which come within the meaning of the claims are intended to be embraced therein.

What is claimed is:

1. A finger switch comprising:

(a) a thin plate made of a bendable material, one edge of said thin plate being mounted near a finger base portion of a player's finger, while another edge of said thin plate is stretched toward a finger tip edge portion of the player's finger, whereby said thin plate can be bent and stretched in response to bending and stretching actions of the player's finger;

(b) a gate member having a gate shape, said gate member being mounted, independently of said thin plate, between said finger base and said finger tip edge of the player's finger, whereby said thin plate is inserted through the inside of said gate member so as to be movable therethrough;

(c) a contact switch mounted to said gate member in a direction of the finger tip edge portion thereof; and (d) a contact switch driving member mounted to said thin plate at said another edge thereof, said contact driving member driving said contact switch to turn on and off in response to the bending and stretching movement of said thin plate.

2. A finger switch according to claim 1, wherein said contact switch includes a push button and said contact switch driving member at least comprises:

(a) a spring, one edge of which is fixed at said another edge of said thin plate; and (b) a movable member which is connected to another edge of said spring, whereby said movable member is moved toward said push button along the player's finger based on the elastic restoring force of said spring so that said push button can be pushed by said movable member in response to the bending and stretching actions of the player's finger so as to activate said contact switch.

3. A finger switch according to claim 1, wherein said contact switch includes a push button and said contact switch driving member comprises:

(a) an enclosure mounted at said another edge of said thin plate, an opening of said enclosure being directed toward said push button;

(b) at least one spring, one edge of which is fixed at a bottom portion of said enclosure;

(c) a movable member which is connected to another edge of said spring, whereby said movable member is moved in and out of said cylinder along the player's finger based on the elastic restoring force of said spring so that said push button can be pushed by said movable member in response to the bending and stretching actions of the player's finger so as to activate said contact switch.

* * * * *